US007714781B2

(12) United States Patent
Xia et al.

(10) Patent No.: US 7,714,781 B2
(45) Date of Patent: May 11, 2010

(54) METHOD AND SYSTEM FOR ANALOG BEAMFORMING IN WIRELESS COMMUNICATION SYSTEMS

(75) Inventors: Pengfei Xia, Mountain View, CA (US); Huaning Niu, Sunnyvale, CA (US); Chiu Ngo, San Francisco, CA (US)

(73) Assignee: Samsung Electronics Co., Ltd., Suwon (KR)

( * ) Notice: Subject to any disclaimer, the term of this patent is extended or adjusted under 35 U.S.C. 154(b) by 323 days.

(21) Appl. No.: 11/899,286

(22) Filed: Sep. 5, 2007

(65) Prior Publication Data

US 2009/0058724 A1 Mar. 5, 2009

(51) Int. Cl.
*H01Q 3/26* (2006.01)

(52) U.S. Cl. ..... 342/370

(58) Field of Classification Search ..... 342/368–370, 342/372–373, 377; 455/276.1, 277.1, 562.1
See application file for complete search history.

(56) References Cited

U.S. PATENT DOCUMENTS

| | | | | |
|---|---|---|---|---|
| 5,955,991 | A | 9/1999 | Kawakubo | |
| 6,590,532 | B1 | 7/2003 | Ogawa et al. | |
| 6,795,392 | B1 | 9/2004 | Li et al. | |
| 6,847,832 | B2 | 1/2005 | Wong et al. | |
| 6,937,189 | B2 | 8/2005 | Kim | |
| 7,013,165 | B2 | 3/2006 | Yoon et al. | |
| 7,039,370 | B2 | 5/2006 | Laroia et al. | |
| 7,161,534 | B2 | 1/2007 | Tsai et al. | |
| 7,239,893 | B2 * | 7/2007 | Yang | 455/561 |
| 7,312,750 | B2 | 12/2007 | Mao et al. | |
| 7,342,535 | B2 | 3/2008 | Ann et al. | |
| 7,450,659 | B2 | 11/2008 | Corredoura et al. | |
| 2002/0122498 | A1 * | 9/2002 | Dogan | 375/259 |
| 2005/0276347 | A1 | 12/2005 | Mujtaba et al. | |
| 2006/0104382 | A1 | 5/2006 | Yang et al. | |
| 2006/0234645 | A1 | 10/2006 | Lin et al. | |
| 2006/0248429 | A1 | 11/2006 | Grandhi et al. | |
| 2007/0189412 | A1 | 8/2007 | Xia et al. | |
| 2007/0205943 | A1 * | 9/2007 | Nassiri-Toussi et al. | 342/377 |
| 2008/0101493 | A1 | 5/2008 | Niu et al. | |
| 2008/0108390 | A1 | 5/2008 | Yoon et al. | |

(Continued)

FOREIGN PATENT DOCUMENTS

| | | |
|---|---|---|
| JP | 2004140642 | 5/2004 |

OTHER PUBLICATIONS

S. Buzzi et al., Performance of iterative data detection and channel estimation for single-antenna and multiple-antennas wireless communications, IEEE Transactions on Vehicular Technology, vol. 53(4), p. 1085-1104, Jul. 2004.*

(Continued)

*Primary Examiner*—Thomas H Tarcza
*Assistant Examiner*—Fred H Mull
(74) *Attorney, Agent, or Firm*—Kenneth L. Sherman, Esq.; Michael Zarrabian, Esq.; Myers Andras Sherman LLP

(57) ABSTRACT

A method and system for analog beamforming in wireless communication system, is provided. Analog beamforming coefficients are constructed by performing an iterative beam acquisition process based on beam search training, and determining optimized beamforming weighting coefficients based on the iterative beam acquisition process.

28 Claims, 13 Drawing Sheets

130

U.S. PATENT DOCUMENTS

| | | | | |
|---|---|---|---|---|
| 2008/0134254 | A1* | 6/2008 | Xia et al. | 725/62 |
| 2008/0144751 | A1* | 6/2008 | Xia et al. | 375/347 |
| 2008/0204319 | A1 | 8/2008 | Niu et al. | |
| 2009/0033555 | A1 | 2/2009 | Niu et al. | 342/377 |
| 2009/0121935 | A1 | 5/2009 | Xia et al. | |

OTHER PUBLICATIONS

G. Stuber, J. Barry, S. McLaughlin, Y. Li, M. Ingram, and T. Pratt, "Broadband MIMO-OFDM wireless communications," *Proceedings of the IEEE*, vol. 92, No. 2, pp. 271-294, Feb. 2004.

Van Veen, B. D., Buckley K. M., "Beamforming: a versatile approach to spatial filtering," ASSP Magazine, IEEE, vol. 5, Iss. 2, Apr. 1988, p. 4-24.

Butler, J. et al., "Beam-Forming Matrix Simplifies Design of Electronically Scanned Antennas." Electronic Design, Apr. 12, 1961, pp. 170-173, United States.

"High-Definition Multimedia Interface Specification Version 1.2," Aug. 22, 2005, United States.

"Wireless MAC and PHY Specifications for High Rate WPANs," IEEE Std 802.15.3-2003, Sep. 29, 2003, United States.

Hansen, R.C., Phased Array Antennas, pp. 1-507, John Wiley and Songs, New York, 1998, United States.

Coffey, S. et al., "Joint Proposal: High throughput extension to the 802.11 Standard: PHY" IEEE 802.11-05/1102r4, draft proposal, Jan. 2006, pp. 1-82, United States.

Niu, H. et al., "Beamforming for Space-Time Coded IEEE 802.11n System with Known Fading Correlations," in Proceeding of 39th Asilomar Conference on Signals, Systems and Computers, Pacific Grove, CA, Nov. 2005, United States.

De Los Santos, J., "MEMS-Based Microwave Circuits and Systems, Introduction to Microelectromechanical (MEM) Microwave Systems," Artech House, pp. 167-168 and 193, 1999, United States.

Furrer, S. et al., "Bounds on the ergodic capactiy of training-based multiple-antenna systems," Internal Symposium on Information Theory, Sep. 2005, pp. 780-784, United States.

802.11 Working Group of the 802 Committee, "Draft Amendment to Standard for Information Technology-Telecommunications and information exchange between systems-Local and metropolitan are networks- Specific requirements—Part 11: Wireless LAN Medium Access Control (MAC) and Physical Layer (PHY) specifications: Enhancements for Higher Throughput," IEEE P802.11n/D1.0, Mar. 2006, pp. 1-335, United States.

WirelessHD Specification draft version 0.7, WirelessHD consortium, Feb. 2007, United States.

Scintera Networks, "Advanced Signal Processing Platform," Sep. 2003, United States.

Razavi, B., "Challenges in Portable RF Transceiver Design." Circuits & Devices, 8755-3996/96, IEEE, Sep. 1996, pp. 12-24, United States.

U.S. Non-Final Office Action for U.S. Appl. No. 11/706,942 mailed Oct. 15, 2008.

U.S. Non-Final Office Action for U.S. Appl. No. 11/890,207 mailed Jun. 23, 2008.

U.S. Final Office Action for U.S. Appl. No. 11/890,207 mailed Nov. 24, 2008.

U.S. Advisory Action for U.S. Appl. No. 11/890,207 mailed Mar. 2, 2009.

U.S. Final Office Action for U.S. Appl. No. 11/890,207 mailed Oct. 26, 2009.

U.S. Non-Final Office Action for U.S. Appl. No. 11/890,207 mailed Apr. 6, 2009.

U.S. Non-Final Office Action for U.S. Appl. No. 11/881,978 mailed Jul. 25, 2008.

U.S. Non-Final Office Action for U.S. Appl. No. 11/881,978 mailed Jan. 2, 2009.

U.S. Notice of Allowance for U.S. Appl. No. 11/881,978 mailed Sep. 15, 2009.

* cited by examiner

100

130

200

250

300

350

400

500

504

600

700

800

METHOD AND SYSTEM FOR ANALOG BEAMFORMING IN WIRELESS COMMUNICATION SYSTEMS

FIELD OF THE INVENTION

The present invention relates to wireless communications and in particular to beamforming in wireless communication systems.

BACKGROUND OF THE INVENTION

In wireless communication systems including transmitters and receivers, antenna array beamforming provides increased signal quality (high directional antenna beamforming gain) and an extended communication range by steering the transmitted signal in a narrow direction. For this reason, such beamforming has been widely adopted in radar, sonar and other communication systems.

The beamforming operation can be implemented either in the analog domain (i.e., before an analog-to-digital (A/D or ADC) converter at the receiver and after a digital-to-analog (D/A or DAC) converter at the transmitter), or in the digital domain (i.e., after the A/D converter at the receiver and before the D/A converter at the transmitter).

In conventional multiple-input multiple-output (MIMO) orthogonal frequency division multiplexing (OFDM) wireless systems, transmit and/or receive beamforming is implemented in the digital domain. Specifically, in such systems digital beamforming is implemented before an inverse Fast Fourier Transform (IFFT) operation at the transmitter, and after a FFT operation at the receiver.

Though digital beamforming improves performance, such improvement is at the cost of N radio frequency (RF) chains and N IFFT/FFT operations, wherein N is the number of antennas. For digital beamformed MIMO OFDM systems, beamforming vectors are obtained separately for each and every subcarrier, which generally involves a decomposition operation on each subcarrier. Further, singular value decomposition, or eigenvalue decomposition is normally needed. The complexity of the operations further increases as sampling frequency increases.

BRIEF SUMMARY OF THE INVENTION

The present invention provides a method and system for analog beamforming in wireless communication systems. One embodiment involves constructing analog beamforming coefficients by performing an iterative beam acquisition process based on beam search training, and determining optimized beamforming weighting coefficients based on the iterative beam acquisition process.

In one implementation, beamforming coefficients are obtained iteratively, where each iteration includes finding interim receive beamforming coefficients and finding interim transmit beamforming coefficients. At the end of a terminating iteration, the beamforming coefficients converge to optimized transmit and receive beamforming coefficients as beamforming vectors for steering transmissions.

These and other features, aspects and advantages of the present invention will become understood with reference to the following description, appended claims and accompanying figures.

DETAILED DESCRIPTION OF THE INVENTION

The present invention provides a method and system for analog beamforming in wireless communication systems. In one embodiment, the present invention provides a beam search training process for constructing analog beamforming vectors for a MIMO OFDM analog beamforming wireless communication system. Constructing analog beamforming vectors involves determining beamforming coefficients for analog beamforming at transmit and/or receive sides of a MIMO OFDM system.

Transmitter-side and/or receiver-side analog beamforming in the MIMO OFDM system requires only one RF chain and one Fast Fourier Transform (FFT) operation for multiple antennas in an antenna array, which considerably lowers the system cost. Transmit and receive beamforming coefficients are obtained iteratively, wherein each iteration includes two steps. The first step involves finding interim receive beamforming coefficients and the second step involves finding interim transmit beamforming coefficients. At the end of a terminating iteration, the beamforming coefficients converge to optimized transmit and receive beamforming coefficients as beamforming vectors for steering transmissions.

Figure 1:
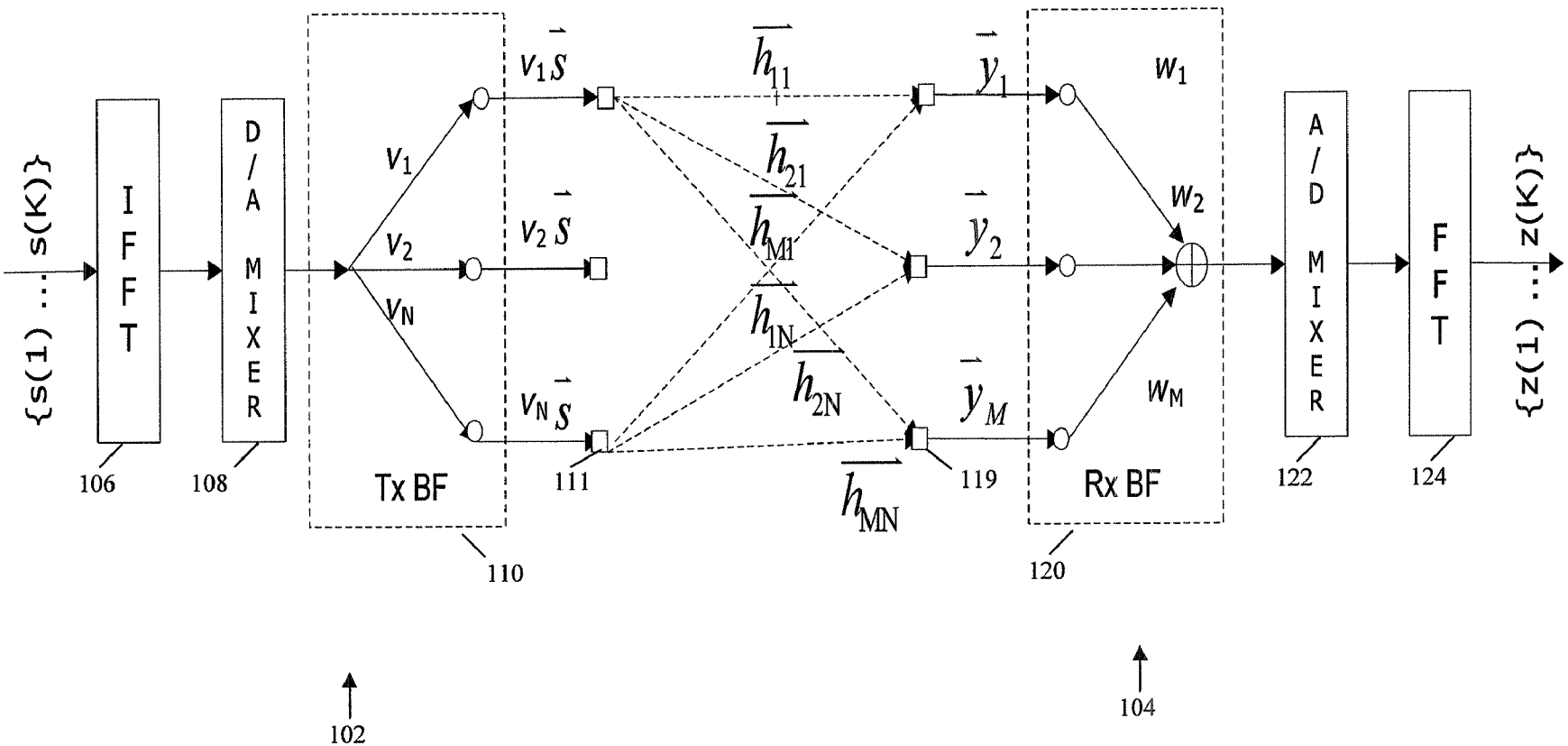
FIG. 1 shows a functional block diagram of an analog beamforming MIMO OFDM wireless communication system, according to an embodiment of the present invention.

In one implementation, an iterative beam acquisition process is provided for constructing optimized transmit and receive beamforming vectors. Each iteration involves estimating receive and transmit beamforming vectors alternatively, until receive and transmit beamforming vectors converge in a terminating iteration. FIG. 1 illustrates a functional block diagram of an example wireless MIMO OFDM system 100 (e.g., a transceiver) employing transmit and receive analog beamforming at both the transmit and receive antennas, according to the present invention. The system 100 includes a transmitter (Tx) 102 and a receiver (Rx) 104, such as in a transceiver, and are configured to communicate over wireless channels.

In the transmitter 102, standard forward error correction (FEC) coding and modulation are applied onto the information bits for transmission. FEC coding increases the robustness of data transmission so that the data can be correctly received at the receiver 104 under unfavorable channel conditions. Since binary information bits are not suitable for radio transmission, modulation converts the binary information bits into a complex signal ($\vec{s}=\{s(1), \ldots, s(K)\}$) which is more suitable for radio transmissions. After the FEC coding and modulation, an IFFT function and a D/A and mixing function are applied before analog beamforming. An IFFT module 106 mainly converts the signal from the frequency domain into a time domain digital signal. The digital signal is then converted into an analog waveform by a D/A converter of a module 108, and is then upconverted onto a carrier frequency via a mixer function of the module 108. Then, a Tx BF module 110 performs analog transmit beamforming for data transmission over a channel $\vec{h}$ via multiple antennas 111.

In the receiver 104, the transmitted signals are received at a plurality of antennas 119; wherein beamforming is performed by an Rx BF module 120 that performs receive analog beamforming, before an A/D conversion and mixing module 122 and an FFT module 124. The received information signal is down-converted from the carrier frequency to a baseband analog signal via the mixing function of the 122, and the A/D conversion function converts the baseband analog signal into the digital domain for digital processing, wherein the digital signal is then converted to a digital signal. Thereafter, the digital signal is demodulated to reverse the modulation operation performed at the transmitter. The demodulated information bits are then decoded by FEC decoding resulting into usable information bits at the receiver 104.

In the example system 100, K is the number of subcarriers for OFDM modulation, M is the number of receive antennas 119, and N is the number of transmit antennas 111 (M and N can be different). The Tx BF module 110 of the transmitter 102 implements a transmit beamforming vector $\vec{v}=[v_1, v_2, \ldots, v_N]^T$ (i.e., a collection of the transmit beamforming weighting coefficients into a vector form), whereby the transmitter 102 transmits information symbols $\vec{s}$ as a vector $v_1\vec{s}$, $v_2\vec{s}, \ldots, v_N\vec{s}$ over N transmit antennas 111, as shown in FIG. 1. The Rx BF module 120 of the receiver 104 implements a receive beamforming vector $\vec{w}=[w_1, w_2, \ldots, w_M]^T$ (i.e., a collection of the receive beamforming weighting coefficients in a vector form), whereby the receiver 104 generates the vector $\vec{z}=\{z1, \ldots, zK\}$ from received vectors $y_1, y_2, \ldots, y_M$ (wherein $\vec{y}=[y_1, y_2, \ldots, y_M]^T$).

The transmit beamforming vector $\vec{v}$ can be of the form: $\vec{v}(\phi)=[1, e^{jkd\cos\phi}, e^{j2kd\cos\phi}, \ldots, e^{j(N-1)kd\cos\phi}]^T$, and the receive beamforming vector $\vec{w}$ can be of the form: $\vec{w}(\theta)=[1, e^{jkd\cos\theta}, e^{j2kd\cos\theta}, \ldots, e^{j(M-1)kd\cos\theta}]^T$, wherein d is the inter-antenna distance assuming a uniform linear array, $\phi$ is the angle of departure and $\theta$ is the angle of arrival.

Further, the transmit beamforming vector $\vec{v}$ can be of the general form $\vec{v}=[v_1, v_2, \ldots, v_N]^T$, i.e., without any constraint on the phase weighting coefficients $v_1, v_2, \ldots, v_N$. The same applies to the receive beamforming vector. In particular, the receive beamforming vector can be of the general form $\vec{w}=[w_1, w_2, \ldots, w_M]^T$, i.e., without any constraint on the phase weighting coefficients $w_1, w_2, \ldots, w_M$. The resulting beamforming vectors ($\vec{v}$, $\vec{w}$) are used to steer the transmission phase shifts in the transmission stages (e.g., the phase shift array) for communication of actual payload data.

If L+1 is the maximum number of taps for each pair of transmit and receive antennas, without loss of generality, then it is reasonable to assume that K>>L+1. Then, the channel vector $\vec{h}_{ij}=[h_{ij}(0)\ h_{ij}(1)\ \ldots\ h_{ij}(L)\ 0\ \ldots\ 0]^T$ represents a multi-path time domain channel between the ith receive and the jth transmit antenna pair. Here, the channel vector $\vec{h}_{ij}$ is padded with 0's to be of size K×1. There are altogether M×N such channel vectors, with each one corresponding to one transmit and receive antenna pair. Therefore, assuming $S=\mathrm{diag}(\vec{s})$ represents the diagonal matrix containing all the K data symbols in an OFDM symbol, then the transmitted vector (over an OFDM symbol duration) on the jth transmit antenna from the transmitter 102 is represented as $[v_j s_1, v_j s_2, \ldots v_j s_K]$, wherein: j=1, . . . , N; the vector $\vec{s}=(s_1, s_2, \ldots, s_K)=\{s(1), \ldots, s(K)\}$, such that $S=\mathrm{diag}(s_1, s_2, \ldots, s_K)$.

Further, because OFDM modulation diagonalizes the multi-path channel, the received vector $\vec{y}$ (over time duration K) on the ith receive antenna at the receiver 104 is represented as $$\bar{y}_i = \sum_{j=1}^{N} v_j S \bar{c}_{ij},$$

wherein $\vec{c}_{ij}=F_K\vec{h}_{ij}$ is the frequency channel response corresponding to the time domain channel $\vec{h}_{ij}$, $v_j$ is the jth transmit beamforming coefficient, and $F_K$ is the standard discrete Fourier transform matrix of size K×K. The received vectors $\vec{y}_i$ across all the M receive antennas 119 are weighted using the beamforming vectors $\vec{w}=[w_1, \ldots, w_M]$ and combined in the Rx BF module 120, wherein $w_i$ is the ith receive beamforming coefficient. After A/D and mixing operations in the module 122, and an FFT operation in the module 124, the combined signal vector output $\vec{z}$ from the FFT module 124 can be represented as:

$$\bar{z} = \sum_{i=1}^{M} w_i \bar{y}_i = \sum_{i=1}^{M} w_i \sum_{j=1}^{N} v_j S \bar{c}_{ij} = S \sum_{i=1}^{M} w_i \sum_{j=1}^{N} v_j \bar{c}_{ij}$$
$$= S \sum_{i=1}^{M} w_i A_i \bar{v}$$
$$= SA\bar{v},$$

wherein $\vec{z}=(z_1, z_2, \ldots, z_K)=\{z(1), \ldots, z(K)\}$, the K×N matrix $A_i$ is defined as $A_i=[\vec{c}_{i1}, \ldots, \vec{c}_{iN}]$, and the K×N matrix A is defined as $$A = \sum_{i=1}^{M} w_i A_i.$$

As such, the matrix A is a weighted sum of all component matrices $A_i$, which are the channel matrices in the frequency domain viewed from the transmitter side. Therefore, the matrix A is an equivalent representation for the channel, wherein A is a function of $\vec{w}$.

Further, the combined signal vector output $\vec{z}$ can also be represented as:

$$\bar{z} == S \sum_{j=1}^{N} v_j \sum_{i=1}^{M} w_i \bar{c}_{ij}$$
$$= S \sum_{j=1}^{N} v_j B_j \bar{w}$$
$$= SB\bar{w},$$

wherein the K×M matrix $B_j$ is defined as $B_j=[\vec{c}_{1j}, \ldots, \vec{c}_{Mj}]$, and the K×M matrix B is defined as $$B = \sum_{j=1}^{N} v_j B_j.$$

The matrix B is a weighted sum of all component matrices $B_j$, which are channel matrices in the frequency domain viewed from the receiver side. As such, B is another equivalent representation for the channel, wherein B is a function of $\vec{v}$.

To optimize the transmit and receive beamforming vectors $\vec{v}$ and $\vec{w}$, respectively, it is necessary to solve the following two problems simultaneously:

$$\text{maximize } \vec{w}^H B^H B \vec{w}$$

$$\text{subject to } \|\vec{w}\|=1$$

and $$\text{maximize } \vec{v}^H A^H A \vec{v}$$

$$\text{subject to } \|\vec{v}\|=1$$

The two problems are essentially the same problem, but in different formulations. The matrix A is dependent upon the vector $\vec{w}$, while the matrix B is dependent upon the vector $\vec{v}$. The following example search processes according to the present invention finds transmit and receive beamforming vectors $\vec{v}$ and $\vec{w}$ iteratively, for analog beamforming in MIMO OFDM systems.

Figure 2A:
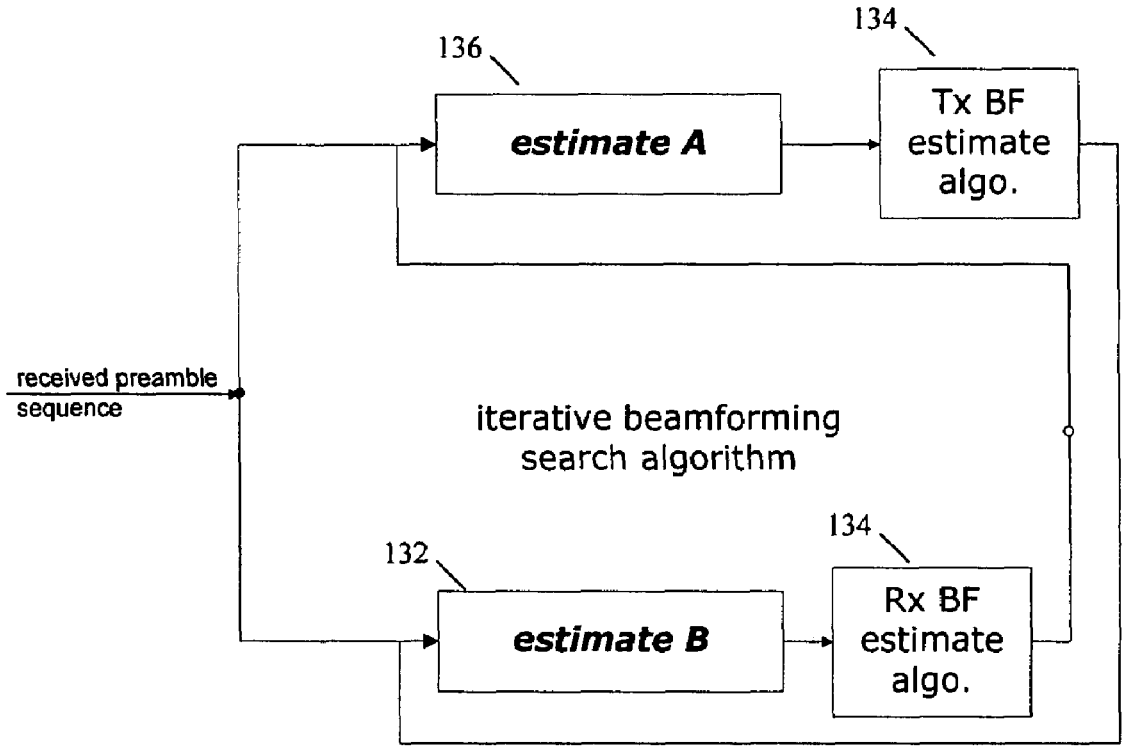
FIG. 2A shows a functional block diagram of an example iterative beamforming search process function for an analog beamformed MIMO OFDM system, according to the present invention.

FIG. 2A shows an example iterative search function 130 implementing a process for finding the beamforming vectors $\vec{v}$ and $\vec{w}$ that are then used for data flow and operation during the payload data communication phase in the analog beamforming MIMO OFDM system 100, according to the present invention. The function 130 is activated only in the channel estimation and beam estimation phase. Before communication of actual payload data, a certain sequence (i.e., a preamble sequence) known to both the transmitter and the receiver is often transmitted, in order for the receiver to perform channel estimation and beam estimation. The search function 130 implements an iterative process, wherein an estimation function 132 estimates the matrix B, an estimation function 134 estimates the receive beamforming vector $\vec{v}$, an estimation function 136 estimates the matrix A, an estimation function 138 estimates the transmit beamforming vector $\vec{w}$, and the process then loops back to the estimation function 132 to estimate the matrix B again in a next iteration step. System performance in terms of error rate is minimized when the transmit and receive beamforming vectors $\vec{v}$ and $\vec{w}$, respectively, converge, indicating that they are optimized.

Figure 2B:
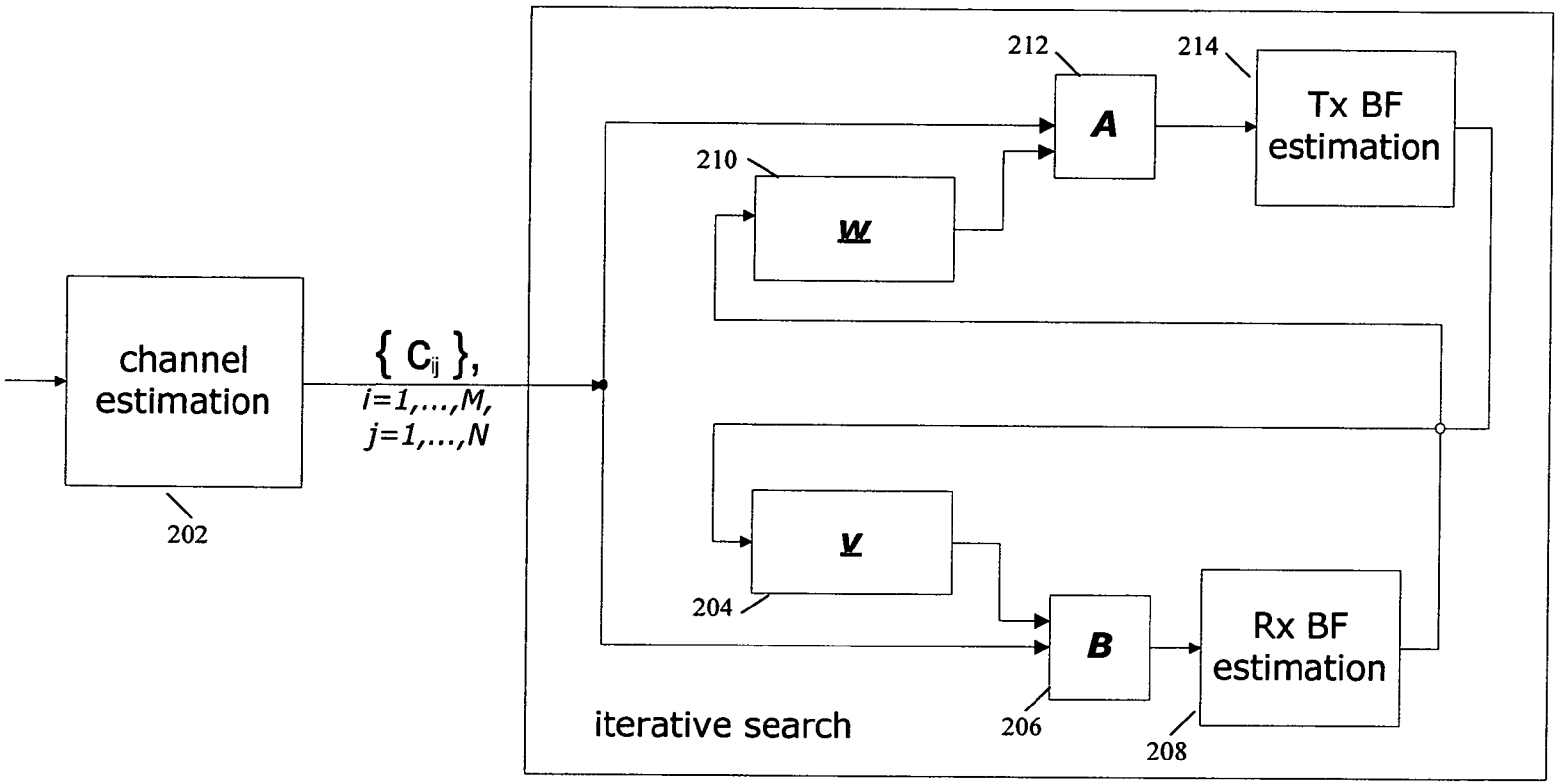
FIG. 2B shows a functional block diagram of another example iterative beamforming search process function for an analog beamformed MIMO OFDM system, according to the present invention.

FIG. 2B shows another example iterative search function 200 implementing a process for finding the beamforming vectors $\vec{v}$ and $\vec{w}$ that are then used for data flow and operation during the payload data communication phase in the analog beamforming MIMO OFDM system 100, according to the present invention. A channel estimation function 202 estimates the channel. This can be done either in the time domain by estimating $\{\vec{h}_{ij}\}$, or in the frequency domain by estimating $\{\vec{c}_{ij}\}$ directly as shown in FIG. 2B. A register 204 is set to a current transmit beamforming vector $\vec{v}_{(p)}$ ($\|\vec{v}_{(p)}\|=1$) which is initialized to a pre-selected transmit beamforming vector $\vec{v}_{(0)}$, wherein p is an iteration index which is initialized to 0. Further, another register 210 is set to a current receive beamforming vector $\vec{w}_{(p)}$ ($\|\vec{w}_{(p)}\|=1$) which is initialized with a pre-selected receive beamforming vector $\vec{w}_{(0)}$.

Then, a B matrix function 206 uses the channel estimate $\{\vec{c}_{ij}\}$ and the vector $\vec{v}_{(p)}$ from the register 204 to form a matrix $B_{(p)}$. Next, a Rx BF estimation function 208 uses the matrix $B_{(p)}$ to generate a new receive beamforming vector $\vec{w}_{(p+1)}$ (i.e., an interim receive beamforming vector $\underline{w}$) Next, the register 210 is updated with the vector $\vec{w}_{(p+1)}$. Next, an A matrix function 212 uses the channel estimate $\{\vec{c}_{ij}\}$ and the vector $\vec{w}_{(p+1)}$ from the register 210 to form a matrix $A_{(p+1)}$.

Next, a Tx BF estimation function 214 uses the matrix $A_{(p+1)}$ to generate a new transmit beamforming vector $\vec{v}_{(p+1)}$ (i.e., an interim receive beamforming vector $\underline{v}$), which is used to update the register 204. Next, the iteration index is incremented as p=p+1, and the process proceeds back to the B matrix function 206 for a further iteration. The iterations are carried out until both the transmit beamforming vector $\vec{v}_{(p)}$ and the receive beamforming vector $\vec{w}_{(p)}$ converge, indicating that they are optimized. System performance in terms of error rate is minimized when the transmit and receive beamforming vectors are optimized. The converged values $\vec{v}_{(p)}$ and $\vec{w}_{(p)}$ represent the values for the transmit and receive beamforming vectors $\vec{v}$ and $\vec{w}$, respectively.

When the channel characteristics change, the above steps for determining transmit and receive beamforming vectors are repeated every several packets to keep up with the changes in the channel. When the channel change is not that frequent, the above steps can still be repeated every several packets, although the number of iterations needed may be less.

Examples of the transmit beamforming vector estimation steps and the receive beamforming vector estimation steps are now provided.

Receive Beamforming Estimation:

1. Obtain an estimate of matrix B, then form $R_B=B^HB$.
2. Estimate the receive beamforming vector as the principle eigenvector of matrix B. Specifically, perform an eigenvalue decomposition of the matrix $R_B=B^HB$, and estimate the receive beamforming vector $\vec{w}$ as the eigenvector that corresponds to the largest eigenvalue of $R_B=B^HB$.

Transmit Beamforming Estimation:

1. Obtain an estimate of the matrix A, then form $R_A=A^HA$.
2. Estimate the transmit beamforming vector as the principle eigenvector of matrix A. Specifically, perform an eigenvalue decomposition of the matrix $R_A=A^HA$, and estimate the transmit beamforming vector $\vec{v}$ as the eigenvector that corresponds to the largest eigenvalue of $R_A=A^HA$.

Several example alternatives for the receive beamforming vector estimation steps are now provided.

First Alternative Receive Beamforming Estimation

1. Estimate the matrix B, then form $R_B=B^HB$. Perform eigen-decomposition of $R_B=U\Sigma U^H$, wherein $\Sigma=\text{diag}[\sigma_1, \ldots, \sigma_N]$ contains all eigenvalues in a non-increasing order, and $U=[\vec{u}_1, \ldots, \vec{u}_N]$ contains all eigenvectors in a corresponding order.
2. Define a matrix $\underline{U}=[\vec{u}_2, \ldots, \vec{u}_N]$ as the last N−1 columns of the original eigenvector matrix U.
3. Define $\vec{b}(\theta)=[1, e^{jkd\cos\theta}, e^{j2kd\cos\theta}, \ldots, e^{j(N-1)kd\cos\theta}]^H$ and form an objective function $\pi(\theta)$ as:

$$\pi(\theta)=\frac{1}{\vec{b}^H(\theta)\underline{U}\underline{U}^H\vec{b}(\theta)}.$$

4. Find the peak of $\pi(\theta)$ and the corresponding $\theta^*$, wherein $\theta^*$ is the estimated angle of departure, such that the receive beamforming vector is $\vec{w}=\vec{b}(\theta^*)$.

Second Alternative Receive Beamforming Estimation

1. Estimate the matrix B, then form $R_B=B^HB$. Perform eigen-decomposition of $R_B=U\Sigma U^H$ wherein $\Sigma=\text{diag}[\sigma_1, \ldots, \sigma_N]$ contains all eigenvalues in the non-increasing order, and $U=[\vec{u}_1, \ldots, \vec{u}_N]$ contains all eigenvectors in the corresponding order.
2. Define vectors $\vec{s}_1$ and $\vec{s}_2$ as:

$$\vec{s}_1=[I_{N-1}\ \vec{0}]\vec{u}_1$$

$$\vec{s}_2=[\vec{0}\ I_{N-1}]\vec{u}_1,$$

wherein $I_{N-1}$ is the size (N−1)×(N−1) identity matrix, and $\vec{0}$ is the all-zero column vector of size (N−1)×1.

3. Determine the estimated angle of departure as:

$$\theta^*=(\vec{s}_1^H\vec{s}_1)^{-1}\vec{s}_1^H\vec{s}_2,$$

such that the receive beamforming vector is estimated as $\vec{w}=\vec{b}(\theta^*)$.

Third Alternative Receive Beamforming Estimation

1. Estimate the matrix B, then form $R_B=B^HB$. Perform eigen-decomposition of $R_B=U\Sigma U^H$ where $\Sigma=\text{diag}[\sigma_1, \ldots, \sigma_N]$ contains all eigenvalues in a non-increasing order, and $U=[\vec{u}_1, \ldots, \vec{u}_N]$ contains all eigenvectors in the corresponding order.
2. Define a matrix $\underline{U}=[\vec{u}_2, \ldots, \vec{u}_N]$ as the last N−1 columns of the original eigenvector matrix U.
3. Find the root, z*, for the relation:

$$b^H(z^{-1})\underline{U}\underline{U}^Hb(z)=0,$$

where $\vec{b}(z)=[1, z^{-1}, \ldots, z^{-(N-1)}]$.

4. Determine the receive beamforming vector as $\vec{w}=\vec{b}(z^*)$.

Fourth Alternative Receive Beamforming Estimation

1. Obtain an estimate of matrix B, then form $R_B=B^HB$.
2. Define $\vec{b}(\theta)=[1, e^{jkd\cos\theta}, e^{j2kd\cos\theta}, \ldots, e^{j(N-1)kd\cos\theta}]^H$ and form an objective function $\pi(\theta)$ as:

$$\pi(\theta)=\frac{1}{\vec{b}^H(\theta)R_B^{-1}\vec{b}(\theta)}.$$

3. Find the peak of $\pi(\theta)$ and the corresponding $\theta^*$, wherein $\theta^*$ is the estimated angle of departure, and the receive beamforming vector is estimated as $\vec{w}=\vec{b}(\theta^*)$.

Several example alternatives for the transmit beamforming vector estimation steps are now provided.

First Alternative Transmit Beamforming Estimation

1. Estimate the matrix A, then form $R_A=A^HA$. Perform eigen-decomposition of $R_A=U\Sigma U^H$ wherein $\Sigma=\text{diag}[\sigma_1, \ldots, \sigma_N]$ contains all eigenvalues in the non-increasing order, and $U=[\vec{u}_1, \ldots, \vec{u}_N]$ contains all eigenvectors in the corresponding order.
2. Define a matrix $\underline{U}=[\vec{u}_2, \ldots, \vec{u}_N]$ as the last M−1 columns of the original eigenvector matrix U.
3. Define a vector $\vec{a}(\phi)=[1, e^{jkd\cos\phi}, e^{j2kd\cos\phi}, \ldots, e^{j(N-1)kd\cos\phi}]^H$ and use it to form an objective function $\rho(\phi)$ as:

$$\rho(\phi) = \frac{1}{\vec{a}^H(\phi)\underline{U}\underline{U}^H\vec{a}(\phi)}.$$

4. Find the peak of $\rho(\phi)$ and the corresponding $\phi^*$, wherein $\phi^*$ is the estimated angle of departure, and the transmit beamforming vector is $\vec{v} = \vec{a}(\phi^*)$.

Second Alternative Transmit Beamforming Estimation

1. Estimate the matrix A and form $R_A = A^H A$. Perform eigen-decomposition of $R_A = U\Sigma U^H$ wherein $\Sigma = \text{diag}[\sigma_1, \ldots, \sigma_M]$ contains all eigenvalues in the non-increasing order, and $U = [\vec{u}_1, \ldots, \vec{u}_N]$ contains all eigenvectors in the corresponding order.
2. Define vectors $\vec{s}_1$ and $\vec{s}_2$ as:

$$\vec{s}_1 = [I_{M-1}\ \vec{0}]\vec{u}_1$$

$$\vec{s}_2 = [\vec{0}\ I_{M-1}]\vec{u}_1,$$

wherein $I_{M-1}$ is the size $(M-1)\times(M-1)$ identity matrix, and $\vec{0}$ is an all-zero column vector of size $(M-1)\times 1$.

3. Determine the estimated angle of departure as:

$$\phi^* = (\vec{s}_1^H \vec{s}_1)^{-1} \vec{s}_1^H \vec{s}_2,$$

wherein the transmit beamforming vector is estimated as $\vec{v} = \vec{a}(\phi^*)$.

Third Alternative Receive Beamforming Estimation

1. Estimate the matrix A and form $R_A = A^H A$. Perform eigen-decomposition of $R_A = U\Sigma U^H$ wherein $\Sigma = \text{diag}[\sigma_1, \ldots, \sigma_N]$ contains all the eigenvalues in a non-increasing order, and $U = [\vec{u}_1, \ldots, \vec{u}_N]$ contains all eigenvectors in a corresponding order.
2. Define a matrix $\underline{U} = [\vec{u}_2, \ldots, \vec{u}_N]$ as the last N−1 columns of the original eigenvector matrix U.
3. Find the root, $t^*$ for the relation:

$$a^H(t^{-1})\underline{U}\underline{U}^H a(t) = 0,$$

where $\vec{a}(t) = [1, t^{-1}, \ldots, t^{-(N-1)}]$.

4. Determine the transmit beamforming vector as $\vec{v} = \vec{a}(t^*)$.

Fourth Alternative Transmit Beamforming Estimation

1. Obtain the matrix A, then form $R_A = A^H A$.
2. Define $\vec{a}(\phi) = [1, e^{jkd\cos\phi}, e^{j2kd\cos\phi}, \ldots, e^{j(N-1)kd\cos\phi}]^H$ and form an objective function $\rho(\phi)$ as:

$$\rho(\phi) = \frac{1}{\vec{a}^H(\phi)R_A^{-1}\vec{a}(\phi)}.$$

3. Find the peak of $\rho(\phi)$ and the corresponding $\phi^*$, wherein $\phi^*$ is the estimated angle of arrival, and the receive beamforming vector is estimated as $\vec{v} = \vec{a}(\phi^*)$.

Analog receive beamforming can be implemented for SIMO OFDM systems, and analog transmit beamforming can be implemented for MISO OFDM systems. The beamforming search functions for the MISO OFDM and SIMO OFDM scenarios are special cases of the iterative beamforming search algorithm for the general MIMO OFDM system, described further above.

Figure 3A:
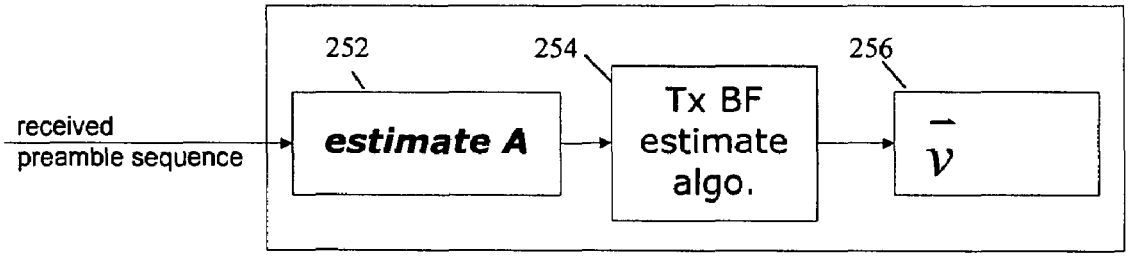
FIG. 3A shows a functional block diagram for an example transmit beamforming vector search process for an analog beamformed multi-input single-output (MISO) OFDM wireless communication system, according to the present invention.

The present invention further provides a MISO OFDM analog beamformed wireless communication system, and a method and system for finding beamforming vectors for such a system. The transmit beamforming vector $\vec{v}$ can be directly obtained from said matrix A. FIG. 3A shows an example transmit beamforming vector search function 250 for a MISO OFDM system. The input to function 250 is the received preamble sequence for the purpose of channel estimation and beam estimation as in FIG. 2A. A matrix function 252 determines the matrix $A = [\vec{c}_{11}, \ldots, \vec{c}_{1N}]$. Then, a Tx BF estimation module 254 uses said matrix A to generate a transmit beamforming vector $\vec{v}$ that is stored in a register 256.

Figure 3B:
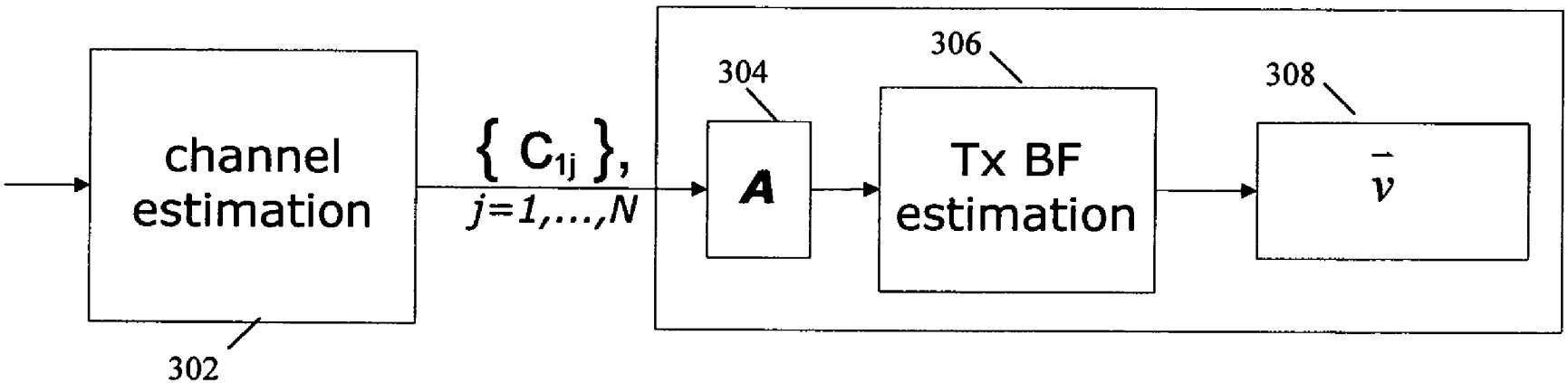
FIG. 3B shows a functional block diagram for another transmit beamforming vector search process for an analog beamformed multi-input single-output (MISO) OFDM wireless communication system, according to an embodiment of the present invention.

FIG. 3B shows another example transmit beamforming vector search function 300 for a MISO OFDM system, wherein first a channel estimation function 302 estimates the channel $\{\vec{c}_{1j}\}$ from the received preamble sequence. Then, a matrix function 304 determines the matrix $A = [\vec{c}_{11}, \ldots, \vec{c}_{1N}]$. Next, a Tx BF estimation function 306 uses said matrix A to generate a transmit beamforming vector $\vec{v}$ that is stored in a register 308.

Figure 4A:
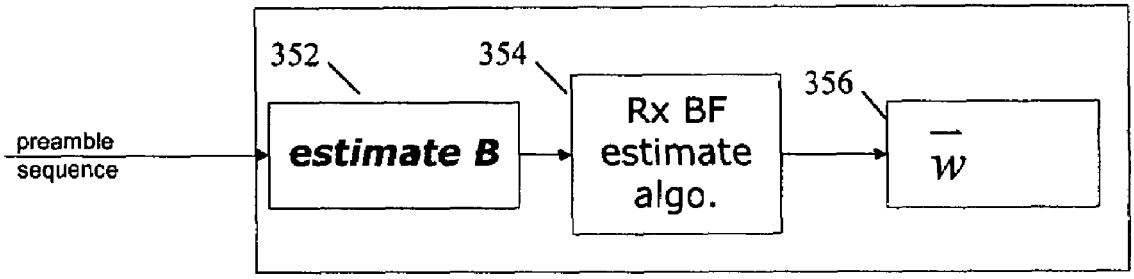
FIG. 4A shows a functional block diagram for an example receive beamforming vector search process for an analog beamformed single-input multi-output (SIMO) OFDM wireless communication system, according to the present invention.

The present invention further provides a SIMO OFDM system, and a method and system for finding beamforming vectors for such a system. The receive beamforming vector $\vec{w}$ can be directly obtained from matrix B. FIG. 4A shows an example receive beamforming vector search function 350 for a SIMO OFDM system. The input to function 350 is the received preamble sequence for the purpose of channel estimation and beam estimation as in FIG. 2A. A matrix function 352 determines the matrix $B = [\vec{c}_{11}, \ldots, \vec{c}_{M1}]$. Next, a Rx BF estimation function 354 uses said matrix B to generate a receive beamforming vector $\vec{w}$ that is stored in a register 356.

Figure 4B:
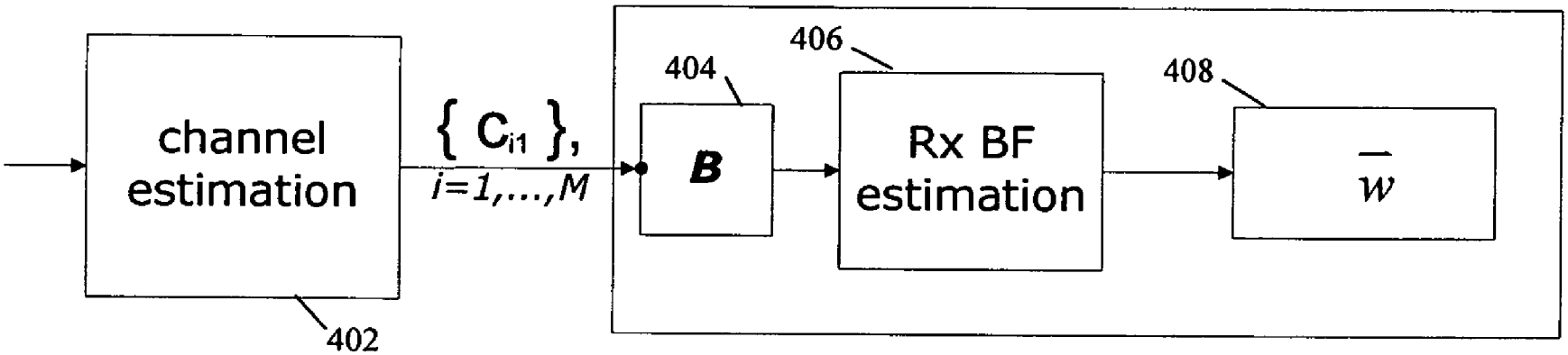
FIG. 4B shows a functional block diagram for another receive beamforming vector search process for an analog beamformed single-input multi-output (SIMO) OFDM wireless communication system, according to the present invention.

FIG. 4B shows an example receive beamforming vector search function 400 for a SIMO OFDM system, wherein first a channel estimation function 402 estimates the channel $\{\vec{c}_{i1}\}$ from said preamble sequence. Then, a matrix function 404 determines the matrix $B = [\vec{c}_{11}, \ldots, \vec{c}_{M1}]$. Next, an Rx BF estimation module 406 uses said matrix B to generate receive beamforming vector $\vec{w}$ that is stored in a register 408.

The present invention further provides an iterative preamble exchange protocol for iterative beam-searching with analog beamforming in a 60 GHz frequency band. Accordingly, in an iterative preamble training protocol using training symbols, and a channel estimation method, at the conclusion of the iterative training protocol and iterative beam-searching, beamforming is carried out simultaneously at the transmitter side and the receiver side, wherein the transmitter and the receiver are equipped with an antenna array. Such an iterative preamble training protocol provides an efficient way to determine a beam vector for analog adaptive beamforming.

In one example of the training process, a transceiver station STA1 enters the transmit mode as a transmitter (Tx). The transmitter transmits a training sequence using the current transmit beamforming vector. The training sequence originating from the transmitter is received at a transceiver station STA2 operating now in a receive mode as a receiver (Rx), and the received training sequence is used to estimate a receive beamforming vector. Preferably, the receiver computes an optimal receive beamforming vector. The receiver then switches to a transmit mode and transmits a training sequence using a beamforming vector that is the same as the current receive beamforming vector. The training sequence originating from station STA2 is then received at the station STA1 operating now in receive mode, and the received training sequence is used to estimate a transmit beamforming vector.

The above steps are repeated $N_{iter}$ times before converging to the final transmit and receive beamforming vectors, indicating that they are optimized. In each iteration step, it is determined if final transmit and receive beamforming vectors have converged and a beam-acquired state is achieved. After the optimized beamforming vectors are obtained, the station STA1 now operating in transmit mode uses the optimized beamforming vector as a Tx beamforming vector and transmits the Tx beamforming vector to the station STA2. The station STA2 now operating in receive mode uses the Tx beamforming vector to determine a final Rx beamforming vector. A final Tx beamforming vector having been acquired, the station STA1 can enter data transmission mode using the Tx beamforming vector. A final Rx beamforming vector having been acquired, the station STA2 can enter data receiving mode using the Rx beamforming vector.

Figure 5:
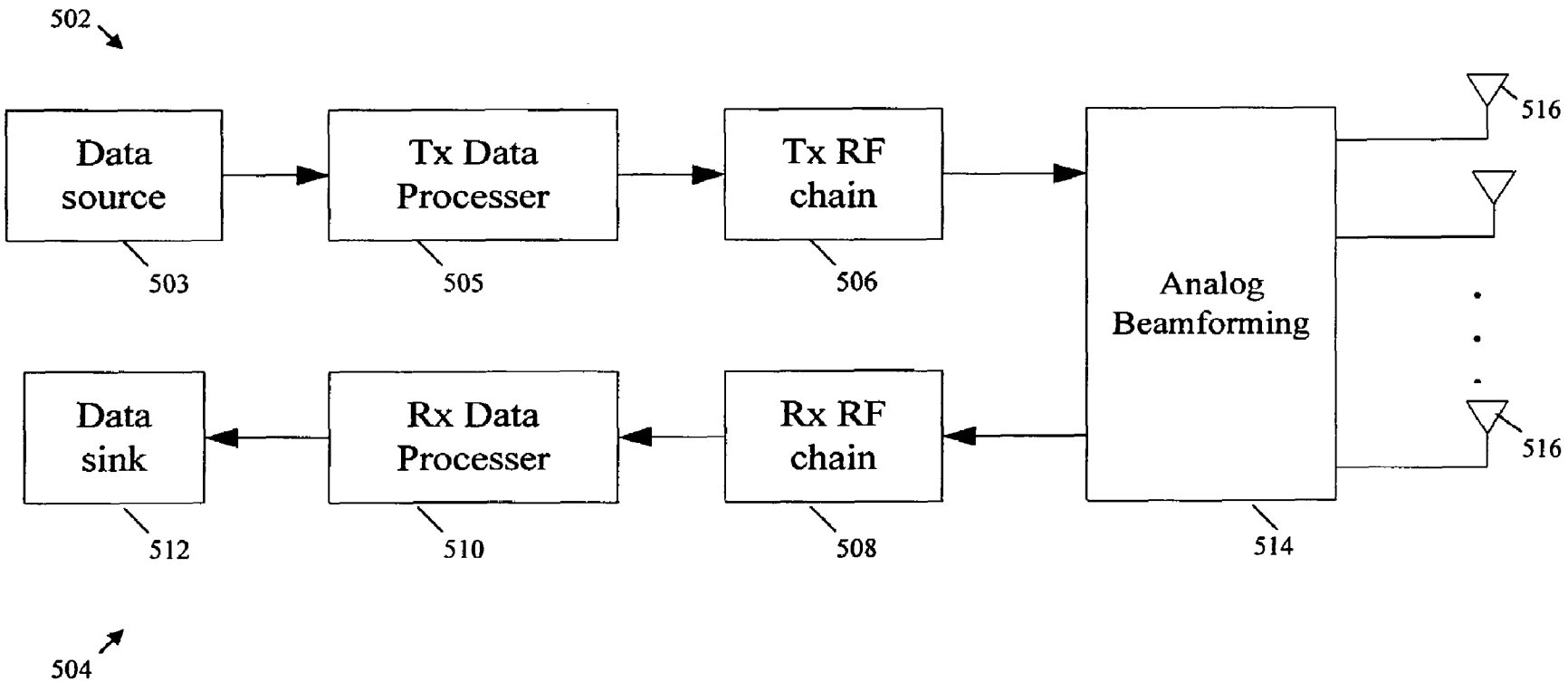
FIG. 5 shows a functional system block diagram for an overall transceiver, according to an embodiment of the present invention.

FIG. 5 shows a functional system block diagram for an overall transceiver 500, including a transmitter side 502 and a receiver side 504, according to an embodiment of the present invention. The transmitter side (Tx) 502 includes a data source 503, a Tx data processor 505 and a Tx RF chain 506. The receiver side (Rx) 504 includes an Rx RF chain 508, an Rx data processor 510 and a data sink 512. Beamforming is performed by an analog beamforming function 514 for communication via an array of antennas 516. The beamforming function 514 implements similar to analog beamforming, for both the transmitter and receiver sides.

Figure 6:
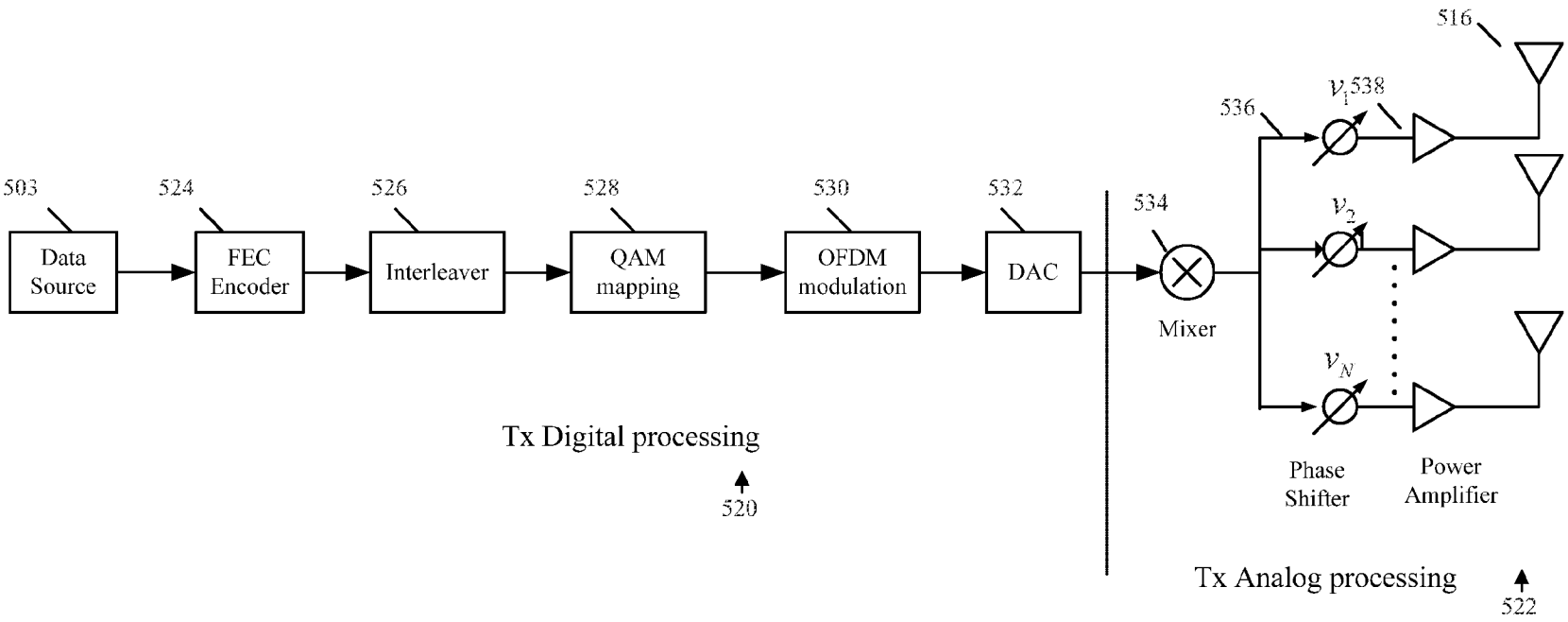
FIG. 6 shows an implementation of the transmitter side of the transceiver in FIG. 5.

FIG. 6 shows an implementation of the transmitter side 502 of the transceiver 500 in FIG. 5. The transmitter side 502 is implemented as having a digital processing section 520 and an analog processing section 522. The digital processing section 520 includes an FEC encoder 524, an interleaver 526, a QAM mapping function 528, an OFDM modulation function 530, and a digital to analog converter (DAC) 532. The analog processing section comprises a mixer 534, and an array of N phase shifters 536 and an array of N power amplifiers 538.

The FEC encoder 524 adds protection to the input information bits by adding redundant bits. The interleaver 526 improves robustness against noise and error by reshuffling the input bits following a certain reshuffling pattern. The QAM mapping function 528 converts binary information bits into digital signals that can be transmitted over the wireless physical channel. The OFDM modulation function 530 converts the information signal from the frequency domain into the time domain. The DAC 532 converts digital signals into the analog domain for input to analog processing for transmission.

The mixer 534 modulates the information carrier signal onto a high frequency carrier so that the information can be transmitted more effectively over the wireless channel. The output from the mixer 534 is replicated to multiple (N) processing paths for multiple (N) corresponding antenna elements. For each path, a phase shifter 536 is applied to the signal before amplification in a power amplifier 538. Each phase shifter controls the signal phase for the corresponding antenna element in the antenna array. The phase shifters can be controlled collectively for forming a desired beam by the antenna elements in the antenna array. Each power amplifier 538 amplifies a signal so that maximum transmit power, under a certain limit, can be achieved.

The Tx data processor 505 in FIG. 5 includes an FEC encoder 524, an interleaver 526, a QAM mapping function 528, and an OFDM modulation function 530 in FIG. 6. Further, the Tx RF chain 506 in FIG. 5 includes the DAC 532 and the mixer 534 in FIG. 6. The analog beamforming 514 in FIG. 5 includes the phase shifter array and the power amplifier array in FIG. 6.

Figure 7:
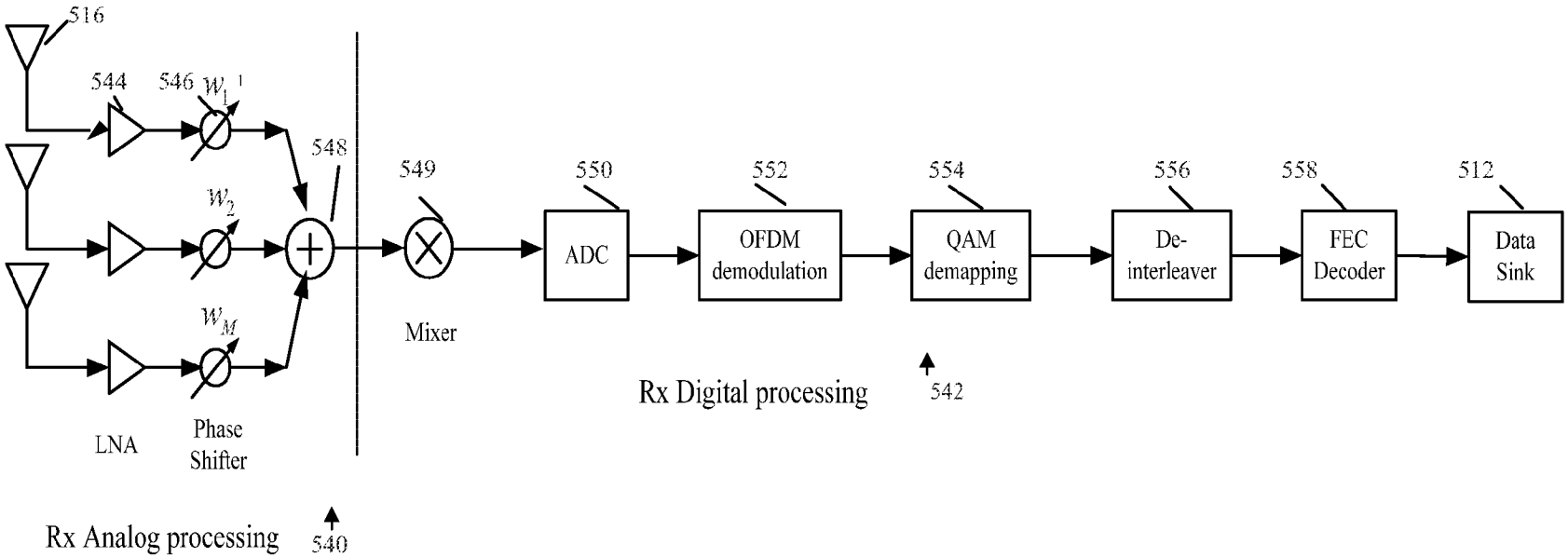
FIG. 7 shows an implementation of the receiver side of the transceiver in FIG. 5.

FIG. 7 shows an implementation of the receiver side 504 of the transceiver 500 in FIG. 5. The receiver side 504 is implemented as having an analog processing section 540 and a digital processing section 542. The analog processing section 540 includes an array of M low noise power amplifiers (LNA) 544, an array of M phase shifters 546 and a combiner 548. The digital section 542 comprises a mixer 549, an ADC 550, an OFDM demodulation function 552, a QAM demapping function 554, a de-interleaver function 556 and a FEC decoder 558.

Each power amplifier 544 in one of M processing paths amplifies the received signal via a corresponding antenna for further processing. Each phase shifter 546 in one of M processing paths control the phase of each corresponding antenna so that a desired receive beamforming pattern can be formed at the receiver side. The combiner 548 sums up the signals from the M processing paths so that a maximum signal quality can be achieved.

The mixer 549 down-converts the information carrier signal from the carrier so that data demodulation and decoding can be performed. The ADC 550 converts a signal from the analog domain to the digital domain. The OFDM demodulation 552 function converts a signal from the time domain to the frequency domain. The QAM demapping function 554 converts a digital signal to binary information bits so that FEC decoding can be performed. The FEC decoder 558 recovers the original information bits, wherein the redundancy bits are used to correct errors on the information bits.

In the receiver part, analog beamforming 514 of FIG. 5 includes the M power amplifiers 544 and phase shifters 546, along with the combiner 548 in FIG. 7. The Rx RF chain 508 in FIG. 5 includes the mixer 549 and the ADC 550 in FIG. 7. The Rx data processor 510 in FIG. 5 includes the OFDM demodulation function 552, the QAM demapping function 554, the deinterleaver 556 and the FEC decoder 558 in FIG. 7.

Although FIGS. 6 and 7 show separate phase shifters, amplifiers and antennas for transmitter and receiver sides, the same set of antennas, phase shifters and amplifier can be reused for a transceiver, serving functions for the transmitter or receiver at different time slots.

Figure 8:
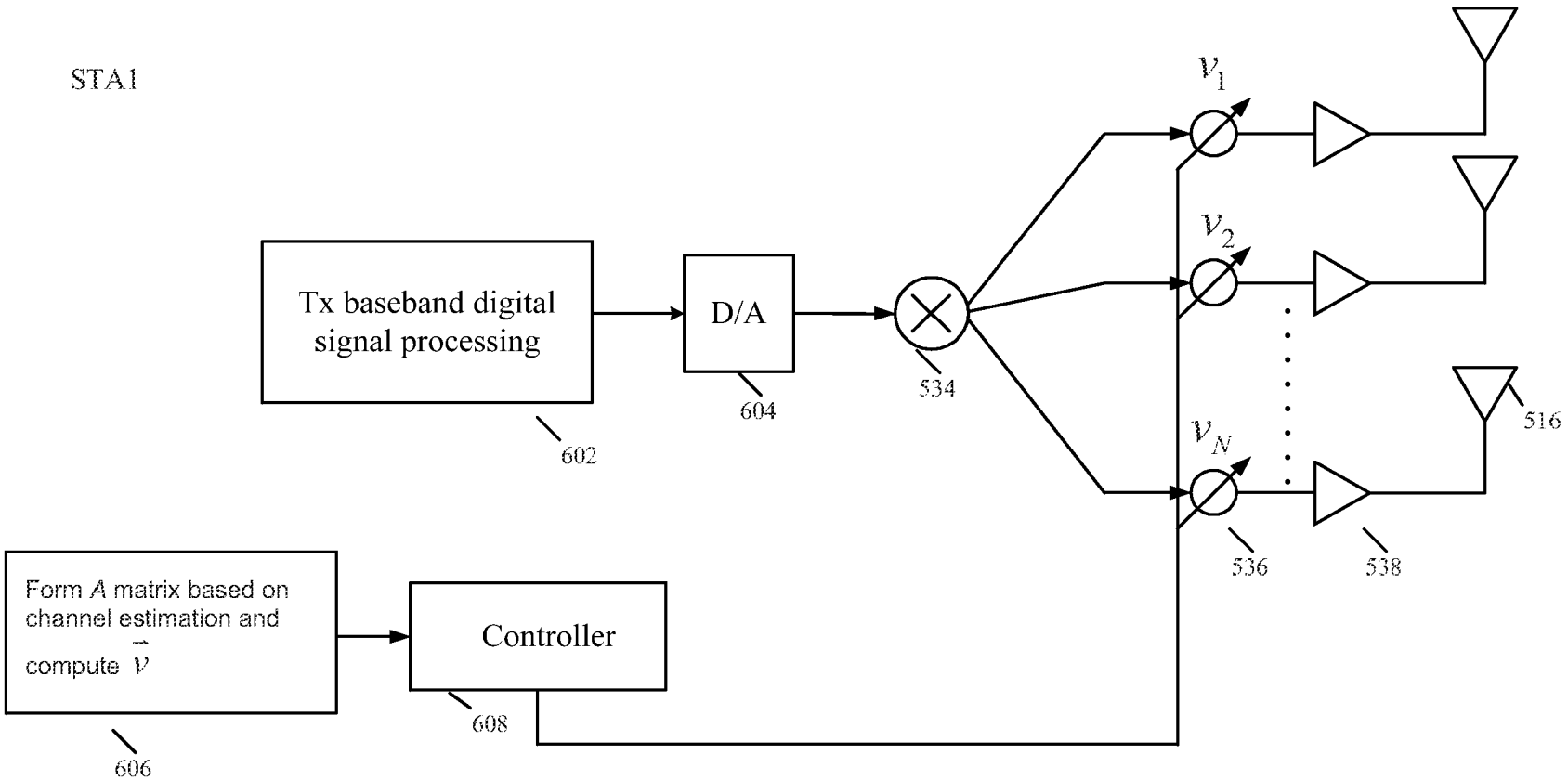
FIGS. 8 and 9 show implementation details for constructing analog beamforming vectors based on an iterative training process, according to an embodiment of the present invention.
Figure 9:
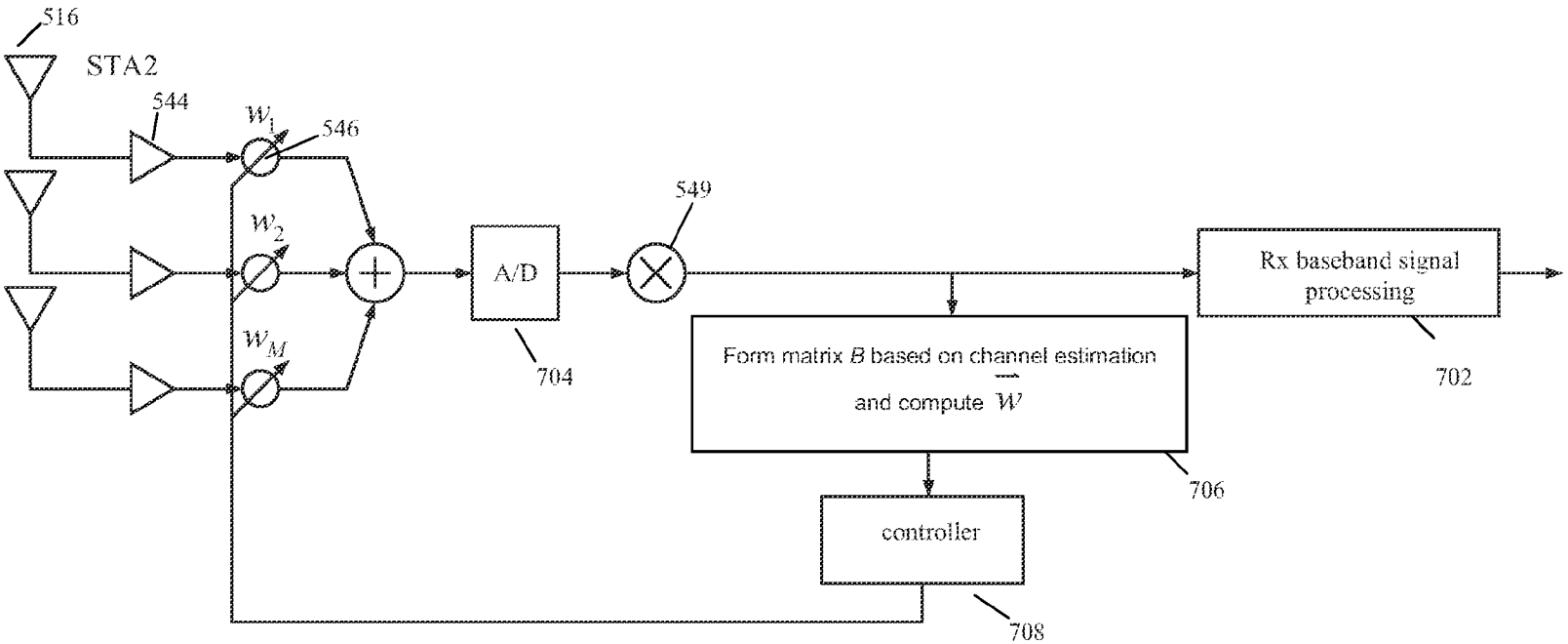

FIGS. 6 and 7 show beamformed data transmission where beamforming vectors are already known. FIGS. 8 and 9 show implementation details for determining beamforming vectors (i.e., beamforming vector training process) corresponding to FIGS. 6 and 7, respectively, before the data transmission begins.

Specifically, FIGS. 8 and 9 show implementation details for constructing analog beamforming vectors based on an iterative training process, according to an embodiment of the present invention. A transmitter STA1 (FIG. 8) includes a mixer 534, an array of N phase shifters 536 and an array of N power amplifiers 538, as described in relation to FIG. 6. The transmitter STA1 implements a Tx baseband digital signal processing function 602 and a D/A 604 which together implement the functions 524 through 532 in FIG. 6. The transmitter STA1 further implements an estimation function 606 that forms the matrix A based on channel estimation, computes the transmit beamforming vector $\vec{v}$ therefrom, as described.

The transmitter further implements a controller 608 that controls the phase values applied to each antenna element on the transmitter side.

The receiver STA2 (FIG. 9) includes a mixer 549, an array of N phase shifters 546 and an array of N power amplifiers 544, as described in relation to FIG. 7. The receiver STA2 implements an Rx baseband digital signal processing function 702 and an A/D device 704 which together implement the functions 550 through 558 in FIG. 7. The receiver STA2 further implements an estimation function 706 that forms the matrix B based on channel estimation and computes the receive beamforming vector $\vec{w}$ therefrom, as described. The receiver STA1 further implements a controller 708 that controls the phase values applied to each antenna element on the receiver side.

Through a sequence of sounding packet exchanges in an iterative process, an optimal beam-vector $\vec{v}$ is obtained at the transmitter STA1 and an optimal beam-vector $\vec{w}$ is obtained at the receiver STA2. The training process assumes channel reciprocity which requires a calibration process. Under the reciprocal condition, the optimal transmit steering vector from STA1 to STA2 is the same as the optimal receive steering vector from STA2 to STA1. Similarly, the optimal receive steering vector from STA2 to STA1 is the same as the optimal transmit steering vector from STA2 to STA1.

Figure 10:
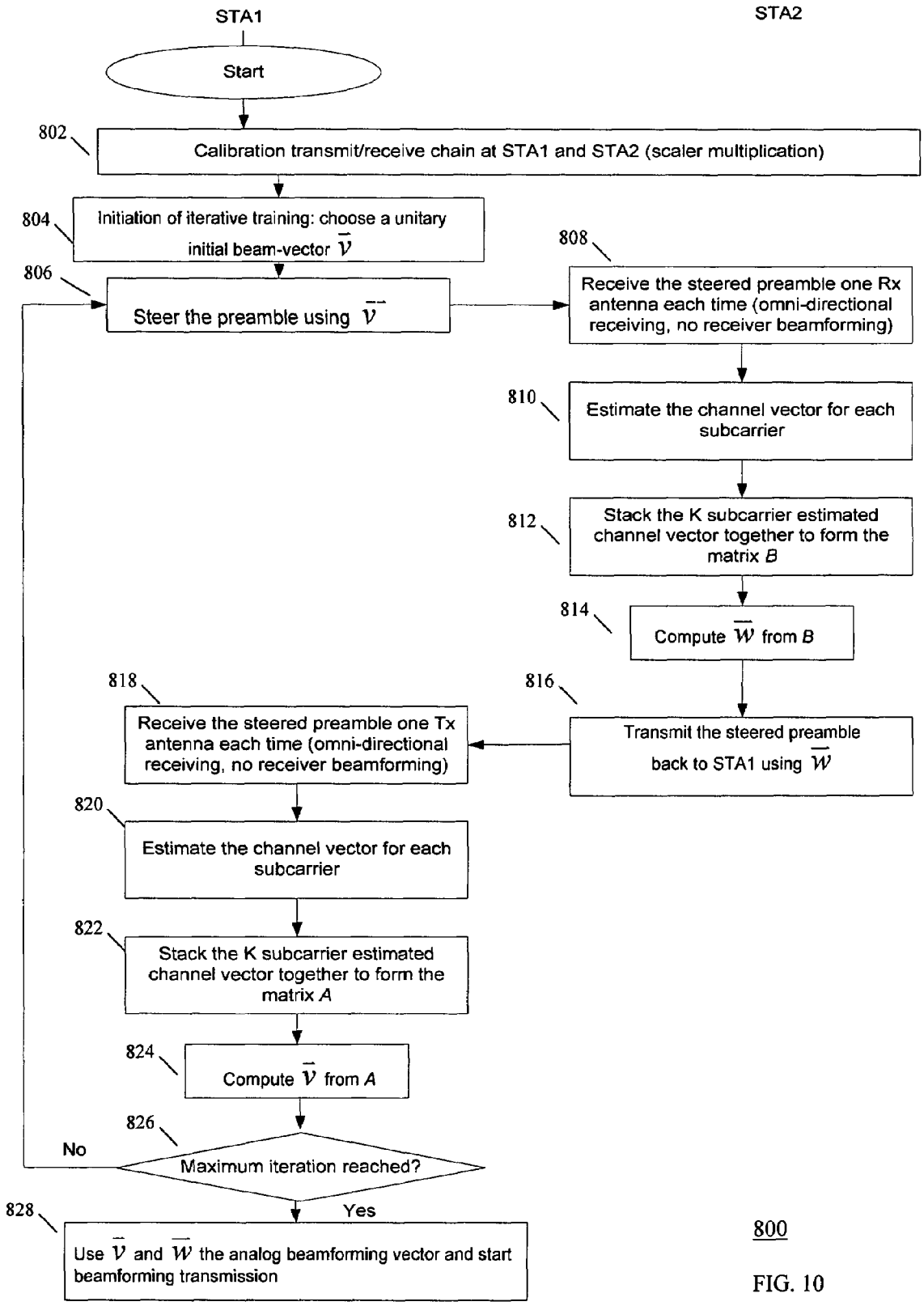
FIG. 10 shows an example iterative training process for calculating a beam vector according to the present invention.

Referring to FIG. 10, an example iterative beam acquisition and training process 800 for calculating beamforming coefficients vector by STA1 and STA2 is illustrated and described below in conjunction with FIG. 2B. The process 800 involves performing an iterative beam acquisition process based on beam search training, and determining optimized beamforming vectors comprising weighting coefficients, based on the iterative beam acquisition process, wherein each iteration includes estimating receive and transmit beamforming coefficients alternatively, until the receive and transmit beamforming coefficients converge. The iterative beam acquisition and training process 800 includes the following steps:

Step 802: Calibration transmit/receive chain at STA1 and STA2 (scalar multiplication).

Step 804: Initiation of iterative training at STA1. Choose a unitary initial transmit beam-vector $\underline{v}$.

Step 806: Transmit a preamble (e.g., training symbol) steered using $\underline{v}$, from STA1 to STA2.

Step 808: Receive the steered preamble at STA2 one Rx antenna each time (omni-directional receiving, no receiver beamforming).

Step 810: Estimate the channel vector at the receiver for each subcarrier (K is the number of subcarriers).

Step 812: Stack the K-subcarrier estimated channel vector together to form the matrix B at STA2.

Step 814: Compute interim receive beamforming vector $\underline{w}$ from B at STA2 based on receiver side antenna diversity and the beam search training.

Step 816: Transmit a preamble (e.g., training symbol) steered using $\underline{w}$ from STA2 back to STA1.

Step 818: Receive the steered preamble one Tx antenna each time (omni-directional receiving, no transmitter beamforming).

Step 820: Estimate the channel vector for each subcarrier at STA1.

Step 822: Stack the K-subcarrier estimated channel vector together to form the matrix A.

Step 824: Compute interim transmit beamforming vector $\underline{v}$ from A at STA1 based on transmitter side antenna diversity and the beam search training.

Step 826: Maximum iteration reached? If yes, STA1 proceeds to step 828, otherwise proceed back to step 806.

Step 828: Use $\vec{v}=\underline{v}$ and $\vec{w}=\underline{w}$ as the analog beamforming vector and start beamforming transmission.

In step 826 above, the maximum iteration number can be a fixed value (e.g., 5). The maximum iteration number can also depend on certain criterion, such as: the overall beamforming gain achieved in the last iteration is not different from the overall beamforming gain achieved in this current iteration by more than 5%. Other criteria can be used.

As is known to those skilled in the art, the aforementioned example architectures described above, according to the present invention, can be implemented in many ways, such as program instructions for execution by a processor, as logic circuits, as an application specific integrated circuit, as firmware, etc. The present invention has been described in considerable detail with reference to certain preferred versions thereof; however, other versions are possible. Therefore, the spirit and scope of the appended claims should not be limited to the description of the preferred versions contained herein.

What is claimed is:

1. A method of analog beamforming in a wireless communication system, comprising the steps of:

constructing analog beamforming coefficients by:

performing an iterative beam acquisition process based on beam search training; and determining optimized beamforming weighting coefficients based on the iterative beam acquisition process, wherein determining includes determining optimized beamforming phase weighting coefficients based on the iterative beam acquisition process, wherein each iteration includes separately estimating receive and transmit analog beamforming coefficients alternately, until the receive and transmit beamforming coefficients converge, wherein estimating the receive analog beamforming coefficients comprises:

estimating a matrix B based on frequency channel response, forming a matrix $R_B=B^HB$, define $\vec{b}(\theta)$ $[1, e^{jkd\cos\theta}, e^{j2kd\cos\theta}, \ldots, e^{j(N-1)kd\cos\theta}]^H$, form a function $$\pi(\theta)=\frac{1}{\bar{b}^H(\theta)R_B^{-1}\bar{b}(\theta)}$$

determine a peak of $\pi(\theta)$ and a corresponding $\theta^*$, where $\theta^*$ is an estimated angle of departure, and estimating a transmit beamforming vector as $\vec{w}=\vec{b}(\theta^*)$; and wherein estimating the transmit analog beamforming coefficients comprises:

estimating a matrix A based on frequency channel response and $\vec{w}$, forming a matrix $R_A=A^HA$, defiine $\vec{a}(\phi)=[1, e^{jkd\cos\phi}, e^{j2kd\cos\phi}, \ldots, e^{j(N-1)kd\cos\phi}]^H$ and form a function $$\rho(\phi)=\frac{1}{\bar{a}^H(\phi)R_A^{-1}\bar{a}(\phi)}$$

determine a peak of $\rho(\phi)$ and a corresponding $\phi^*$, where $\phi^*$ is an estimated angle of arrival, and estimating a receive beamforming vector as $\vec{v} = \vec{a}(\phi^*)$, where d is an inter-antenna distance, $\phi$ is the angle of departure and $\theta$ is the angle of arrival, N is a number of transmit antennas, M is a number of receive antennas, K is a number of subcarriers, j is a positive integer.

2. The method of claim 1 wherein the step of constructing the analog beamforming coefficients further includes performing an iterative process optimize the analog transmit beamforming coefficients from initial values by finding interim receive beamforming coefficients, finding interim transmit beamforming coefficients, wherein at a terminating iteration, optimized transmit and receive beamforming coefficients are obtained.

3. The method of claim 1 wherein performing beam search training further includes:

determining an estimate of an equivalent channel based on a preamble training sequence.

4. The method of claim 3 wherein determining optimized beamforming weighting coefficients further comprises:

selecting initial receive beamforming coefficient values; and performing an iterative process to optimize the analog receive beamforming coefficients from initial values, as a function of the estimated channel.

5. The method of claim 4 wherein the iterative process further includes iteratively optimizing the analog receive beamforming coefficients from initial values, as a function of the estimated channel and analog transmit beamforming coefficients.

6. The method of claim 3 wherein determining optimized beamforming weighting coefficients further comprises:

selecting initial transmit beamforming coefficient values; and performing an iterative process to optimize the analog transmit beamforming coefficients from initial values, as a function of the estimated channel.

7. The method of claim 6 wherein the iterative process further includes iteratively optimizing the analog receive beamforming coefficients from initial values, as a function of the estimated channel and analog receive beamforming coefficients.

8. The method of claim 3 wherein determining the beamforming coefficients further includes determining the analog transmit beamforming coefficients and the analog receive beamforming coefficients by performing an iterative process to optimize the analog transmit beamforming coefficients and the analog receive beamforming coefficients, from initial values, as a function of the estimated channel.

9. The method of claim 8, wherein the iterative process further comprises the steps of:

(a) selecting an initial estimate of the analog transmit beamforming coefficients;

(b) estimating an equivalent channel B based on the estimated channel and the estimated analog transmit beamforming coefficients;

(c) estimating analog receive beamforming coefficients from the estimated equivalent channel B;

(d) estimating an equivalent channel A based on the estimated channel and the estimated analog receive beamforming coefficients;

(e) estimating analog transmit beamforming coefficients from the estimated equivalent channel A; and (f) repeating the steps (b) through (e) until the analog transmit beamforming coefficients and the analog receive beamforming coefficients coverage.

10. The method of claim 9, wherein the iterative process further comprises the steps of:

(a) selecting an initial estimate of the analog receive beamforming coefficients;

(b) estimating an equivalent channel A based on the estimated channel and the estimated analog receive beamforming coefficients;

(c) estimating analog transmit beamforming coefficients from the estimated equivalent channel A;

(d) estimating an equivalent channel B based on the estimated channel and the estimated analog transmit beamforming coefficients;

(e) estimating analog receive beamforming coefficients from the estimated equivalent channel B; and (f) repeating the steps b) through (e) until the analog transmit beamforming coefficients and the analog receive beamforming coefficients converge.

11. The method of claim 1 wherein determining beamforming coefficients further includes determining analog beamforming coefficients for MIMO OFDM communication.

12. The method of claim 1 further including communicating information over a channel by analog beamforming using the analog transmit beamforming coefficients and the analog receive beamforming coefficients.

13. The method of claim 12 wherein the step of communicating the information over the channel comprises the steps of:

applying the analog transmit beamforming coefficients to analog information representing data symbols, to obtain weighted information;

transmit-beamforming the weighted information over multiple paths in a wireless channel;

receiving the information signals;

applying the analog receive beamforming coefficients to the received information signals to obtain weighted information signals; and recovering received data symbols from the weighted information signals.

14. The method of claim 1 wherein performing beam search training further includes:

transmitting a training sequence over a wireless channel;

receiving the training sequence; and estimating beamforming coefficients based on the received training sequence.

15. A wireless receiver, comprising:

an estimation module configured for beam search training; and an analog beamforming module configured for beamforming estimation based on receiver side antenna diversity and the beam search training, wherein beamforming estimation includes iterative beam acquisition process for finding optimized beamforming vectors comprising phase weighting coefficients, each iteration including estimating receive beamforming, wherein the terminating iteration optimized receive beamforming coefficients are obtained, wherein the analog beamforming module is further configured for performing an iterative process to optimize the analog receive beamforming coefficients from initial values by finding interim receive beamforming coefficients, until the receive beamforming coefficients converge with separately estimated transmit beamforming coefficients at a terminating iteration, wherein estimating the receive analog beamforming coefficients comprises:

estimating a matrix B based on frequency channel response, forming a matrix $R_B=B^HB$, define $\vec{b}(\theta)$ $[1, e^{jkd\cos\theta}, e^{j2kd\cos\theta}, \ldots, e^{j(N-1)kd\cos\theta}]^H$, form a function $$\pi(\theta)=\frac{1}{\overline{b}^H(\theta)R_B^{-1}\overline{b}(\theta)}$$

determine a peak of $\pi(\theta)$ and a corresponding $\theta^*$, where $\theta^*$ is an estimated angle of departure, and estimating a transmit beamforming vector as $\vec{w}=\vec{b}(\theta^*)$ and wherein estimating the transmit analog beamforming coefficients comprises:

estimating a matrix A based on frequency channel response and $\vec{w}$, forming a matrix $R_A=A^HA$, define $\vec{a}(\phi)=[1, e^{jkd\cos\theta}, e^{j2kd\cos\theta}, \ldots, e^{j(N-1)kd\cos\theta}]^H$ and form a function $$\rho(\phi)=\frac{1}{\overline{a}^H(\phi)R_A^{-1}\overline{a}(\phi)}$$

determine a peak of $\rho(\phi)$ and a corresponding $\phi^*$, where $\phi^*$ is an estimated angle of arrival, and estimating a receive beamforming vector as $\vec{v}=\vec{a}(\phi^*)$, where d is an inter-antenna distance, $\phi$ is the angle of departure and $\theta$ is the angle of arrival, N is a number of transmit antennas. M is a number of receive antennas, K is a number of subcarriers, j is a positive integer.

16. The wireless receiver of claim 15 wherein the estimation module is configured for:

receiving a training sequence over a wireless channel; and estimating receive beamforming coefficients based on the received training sequence.

17. The wireless receiver of claim 15 wherein the estimation module is configured for determining an estimate of an equivalent channel based on a preamble training sequence.

18. The wireless receiver of claim 17 wherein the beamforming module is further configured for selecting initial receive beamforming coefficient values, and performing an iterative process to optimize the analog receive beamforming coefficients from initial values, as a function of the estimated channel.

19. The wireless receiver of claim 18 wherein the beamforming module is further configured for iteratively optimizing the analog receive beamforming coefficients from initial values, as a function of the estimated channel and analog transmit beamforming coefficients.

20. The wireless receiver of claim 19 wherein the beamforming module is further configured for performing said iterative process by:

(a) selecting an initial estimate of the analog receive beamforming coefficients;

(b) estimating an equivalent channel B based on the estimated channel and the estimated analog receive beamforming coefficients;

(c) estimating an equivalent channel B based on the estimated channel and estimated analog transmit beamforming coefficients;

(d) estimating analog receive beamforming coefficients from the estimated equivalent channel B; and (e) repeating the steps (b) through (d) until the analog transmit beamforming coefficients and the analog receive beamforming coefficients converge.

21. The wireless receiver of claim 15 wherein the beamforming module determines analog beamforming coefficients for MIMO OFDM communication.

22. A wireless transmitter, comprising:

an estimation module configured for beam search training; and an analog module configured for beamforming estimation based on transmitter side antenna diversity and the beam search training, wherein beamforming estimation includes iterative beam acquisition process for finding optimized beamforming vectors comprising phase weighting coefficients, each iteration including estimating transmit beamforming coefficients, wherein at a terminating iteration optimized transmit beamforming coefficients are obtained, wherein the analog beamforming module is further configured for performing an iterative process to optimize the analog transmit beamforming coefficients from initial values by finding interim transmit beamforming coefficients, until the transmit beamforming coefficients converge with separately estimated receive beamforming coefficients at a terminating iteration, wherein estimating the receive analog beamforming coefficients comprises:

estimating a matrix B based on frequency channel response, forming a matrix $R_B=B^HB$, define $\vec{b}(\theta)$ $[1, e^{jkd\cos\theta}, e^{j2kd\cos\theta}, \ldots, e^{j(N-1)kd\cos\theta}]^H$, form a function $$\pi(\theta)=\frac{1}{\overline{b}^H(\theta)R_B^{-1}\overline{b}(\theta)}$$

determine a peak of $\pi(\theta)$ and a corresponding $\theta$, where $\theta^*$ is an estimated angle of departure, and estimating a transmit beamforming vector as $\vec{w}=\vec{b}(\theta^*)$ and wherein estimating the transmit analog beamforming coefficients comprises:

estimating a matrix A based on frequency channel response and $\vec{w}$, forming a matrix $R_A=A^HA$, define $\vec{a}(\phi)=[1, e^{jkd\cos\phi}, e^{j2kd\cos\phi}, \ldots, e^{j(N-1)kd\cos\phi}]^H$ and form a function $$\rho(\phi)=\frac{1}{\overline{a}^H(\phi)R_A^{-1}\overline{a}(\phi)}$$

determine a peak of $\rho(\phi)$ and a corresponding $\phi^*$, where $\phi^*$ is an estimated angle of arrival, and estimating a receive beamforming vector as $\vec{v}=\vec{a}(\phi^*)$, where d is an inter-antenna distance, $\phi$ is the angle of departure and $\theta$ is the angle of arrival, N is a number of transmit antennas, M is a number of receive antennas, K is a number of subcarriers, j is a positive integer.

23. The wireless transmitter of claim 22 wherein the estimation module is configured for:

receiving a training sequence over a wireless channel; and estimating transmit beamforming coefficients based on the received training sequence.

24. The wireless transmitter of claim 23 wherein the estimation module is configured for determining an estimate of an equivalent channel based on a preamble training sequence.

25. The wireless transmitter of claim 24 wherein the beamforming module is further configured for iteratively optimizing the analog transmit beamforming coefficients from initial values, as a function of the estimated channel and analog receive beamforming coefficients.

26. The wireless transmitter of claim 22 wherein the beamforming module is further configured for selecting initial transmit beamforming coefficient values, and performing an iterative process to optimize the analog transmit beamforming coefficients from initial values, as a function of the estimated channel.

27. The wireless transmitter of claim 26 wherein the beamforming module is further configured for performing said iterative process by:

(a) selecting an initial estimate of the analog transmit beamforming coefficients;

(b) estimating an equivalent channel B based on the estimated channel and the estimated analog transmit beamforming coefficients;

(c) estimating an equivalent channel A based on the estimated channel and estimated analog receive beamforming coefficients;

(d) estimating analog transmit beamforming coefficients from the estimated equivalent channel A; and (e) repeating the steps (b) through (d) until the analog transmit beamforming coefficients and the analog receive beamforming coefficients converge.

28. The wireless transmitter of claim 22 wherein the beamforming module determines analog beamforming coefficients for MIMO OFDM communication.

* * * * *